United States Patent [19]

Iwami

[11] Patent Number: 4,818,244

[45] Date of Patent: Apr. 4, 1989

[54] CLOTH WASHING MACHINE

[75] Inventor: Hideo Iwami, Kyoto, Japan

[73] Assignee: Naigai Special Dyeing Co., Ltd., Japan

[21] Appl. No.: 57,963

[22] Filed: Jun. 3, 1987

[30] Foreign Application Priority Data

Dec. 30, 1986 [JP] Japan ..... 61-312761

[51] Int. Cl.[4] ..... D06B 3/12

[52] U.S. Cl. ..... 8/149.1; 68/3 SS; 68/5 D

[58] Field of Search ..... 68/3 SS, 5 C, 5 D, 5 E; 134/64 R, 64 P, 122 R, 122 P, 184; 8/149.1; 26/51

[56] References Cited

U.S. PATENT DOCUMENTS

| | | | |
|---|---|---|---|
| 2,694,307 | 11/1954 | Henry | 68/3 SS |
| 2,699,592 | 1/1955 | Newman | 68/3 SS |
| 3,292,397 | 12/1966 | Wooliever | 68/3 SS X |
| 4,193,842 | 3/1980 | Rushing | 68/3 SS X |
| 4,268,929 | 5/1981 | Sorensen et al. | 68/3 SS X |

FOREIGN PATENT DOCUMENTS

| | | | |
|---|---|---|---|
| 2518939 | 11/1976 | Fed. Rep. of Germany | 68/3 SS |
| 58-29189 | 6/1983 | Japan . | |
| 59-15558 | 1/1984 | Japan . | |
| 60-215866 | 10/1985 | Japan | 68/3 SS |

*Primary Examiner*—Harvey C. Hornsby
*Assistant Examiner*—Frankie L. Stinson
*Attorney, Agent, or Firm*—Lowe, Price, Leblanc, Becker & Shur

[57] ABSTRACT

A cloth washing machine has a group of water tanks arranged in a steaming chamber, and a group of guide rollers arranged either in and out of water tanks, in order to wash cloth supplied into the steaming chamber in swelling in steam and soaking in water repeatedly, and the machine further has a cloth stretching mechanism that keeps cloth stretched on rotationally driving guide rollers and conveys cloth in direction, and a vibrating mechanism that gives direct vibrating motion to cloth so stretched, in order to improve washing effect.

6 Claims, 2 Drawing Sheets

CLOTH WASHING MACHINE

BACKGROUND OF THE INVENTION

Field of the Invention

The present invention relates to a machine for washing cloth; allowing the construction and fiber of cloth, dirts and impurities therein to swell in steam, and to soak in water repeatedly to remove such dirts and impurities.

A washing machine similar to this type is generally used for removing oily and fat components, dirts, impurities and the like stuck on and contained in cloth, and a typical construction thereof is disclosed in Japanese Utility Model Publication (examined) No. 58-29189 titled "Cloth washing machine" for example. To be specific according to the prior art, a steaming chamber is formed to supply hot air into a closed chamber, and several water tanks are arranged side by side at bottom of the steaming chamber. Furthermore, a group of lower guide rollers is arranged side by side below in the chamber and some water tanks. A group of upper guide rollers are arranged above in the steaming chamber corresponding to the arrangement of the lower guide rollers. In the above construction, cloth supplied (fed) into the steaming chamber from a side and conveyed to another, being guided by and taken up on the upper and lower guide rollers. Accordingly, cloth is washed repeatedly by swelling in steam and soaking in water respectively, being guided and conveyed by the guide rollers.

On the other hand, there is an adapted method of giving vibrating motion to cloth in water tank using ultra-sonic generator trying to improve the washing effect. For example, as disclosed in the Japanese Laid-Open Patent Publication (unexamined) No. 59-15558 titled "Ultra-sonic processing method and apparatus thereof", proposed is a method to transfer vibrating motion indirectly to cloth in water through a sliding guide plate.

As mentioned above, various methods have been proposed including ultra-sonic washing method to improve washing effect. However, there still remains a problem that no sufficient washing effect is obtained. Namely, cloth which is free in motion and not stretched would never be vibrated effectively even if vibrating motion is given all over the range in its width, because the vibrating motion generated by a ultra-sonic vibrator is transferred to cloth indirectly and fail to get a sufficient vibrating effect.

SUMMARY OF THE INVENTION

The present invention was made to solve the above problem in aiming to provide a cloth washing machine with both of a stretching mechanism and a vibrating mechanism; a stretching mechanism for stretching cloth between the guide rollers in rotational drive, and conveying cloth in their driving direction, and a vibrating mechanism for vibrating cloth so stretched directly.

By such construction, vibrating motion is given directly to cloth which is kept stretched, and therefore, washing effect of the vibrating motion generated by the vibrating mechanism is improved.

Other objects and futures of the present invention are clearly shown in the following description and supplement drawings.

DESCRIPTION OF THE PREFERRED EMBODIMENT

An embodiment of the present invention is now described below with reference to the drawings.

Figure 1:
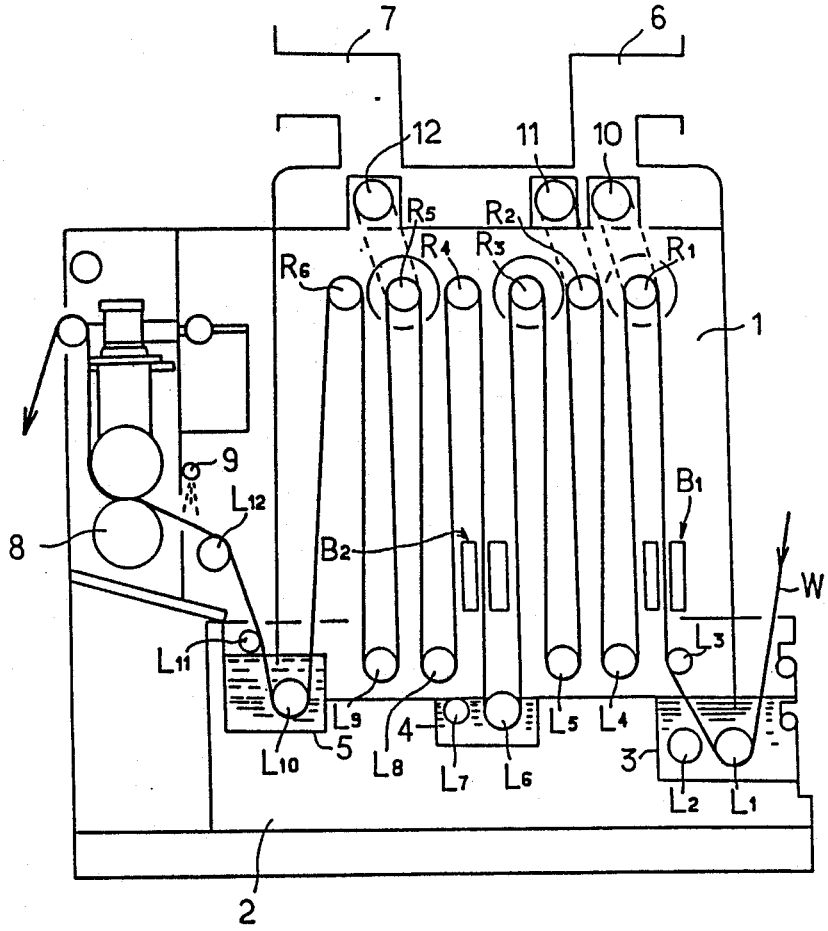
FIG. 1 shows a sectional view of the cloth washing machine embodying the present invention.

In FIG. 1 a longitudinal sectional view shows essential parts of the cloth washing machine as an embodiment of the invention; a closed chamber forming a steaming chamber 1 is provided on the base 2. The reference numeral 6 denotes an inlet of steam (saturated steam) and the numeral 7 an outlet thereof. Water tanks 3, 4 and 5 are arranged side by side at the lower portion of the steaming chamber 1 i.e., on the base 2. A group of guide rollers R1 to R6, L1 to L12 are also arranged side by side in the steaming chamber 1. The reference W denotes cloth supplied from the right side to the steaming chamber 1 and sent out to the left. The numeral 8 denotes a squeezing roller, and 9 a shower. When steam is supplied through inlet 6, temperature in the steaming chamber 1 rises and remains to be 100° C. approximately. Each of water tanks 3, 4, and 5 is filled with water, and water is also heated by steam.

The cloth W supplied first into the first water tank 3 is taken up on guide roller L1 in it and then guided through between the guide rollers L1 to L2 upward to the guide roller L3. Cloth W is then taken up on the guide roller R1, and conveyed further downward. Cloth W is thereafter conveyed through the guide roller from L4 through R2-L5-R3-L6-R4-L8-R5-L9-R6 to the guide roller L10 in the third water tank 5, and then guided further through the guide rollers L11 and L12 to the squeezing roller 8. Water so squeezed from cloth W is drained.

Although the construction mentioned above is not changed from the known art in comparison, the guide rollers R1, R2 and $5 on the upper part in the construction are so forced to drive rotationally in the cloth conveying direction by the torque motors 10, 11 and 12 that a tension force or stretching force is given to cloth W between the guide rollers L3 and R1, guide rollers L4 and R2, and guide rollers L8 and L5 respectively. The stretching force between the rollers L4 and R2 is extended to cloth W between the guide rollers L6 and R4.

Furthermore, according to the present invention, provided are two units of vibrating mechanism B1 and B2. B1 unit is to give vibrating motion to cloth between the guide rollers L3 and R1, and B2 between the guide rollers L6 and R4.

An ultra-sonic micro-vibration generator or oscillator with a rotary plate is, for example, applied to the units of vibrating mechanism B1 and B2. Each of the units B1 and B2 is to be featured in the function to come in contact with cloth in all area in its horizontal direction, and to transfer the vibrating motion directly thereto. Construction of each unit is shown in FIGS. 2 and 3.

Figure 2:
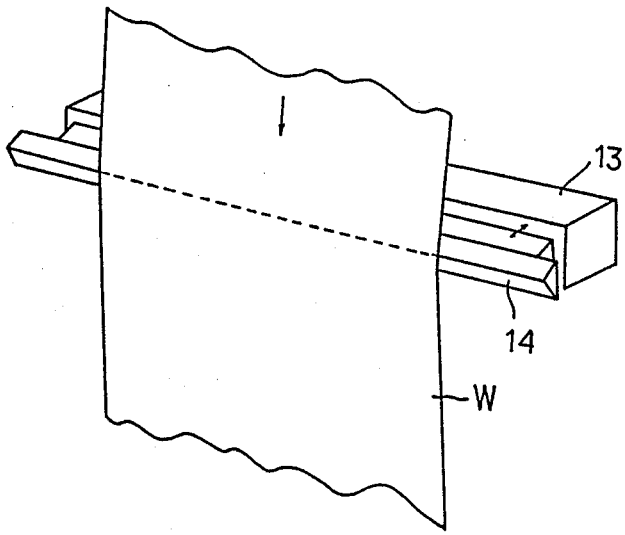
FIGS. 2 and 3 are showing perspective view of an example of the vibrating mechanism applied to the cloth washing machine.
Figure 3:
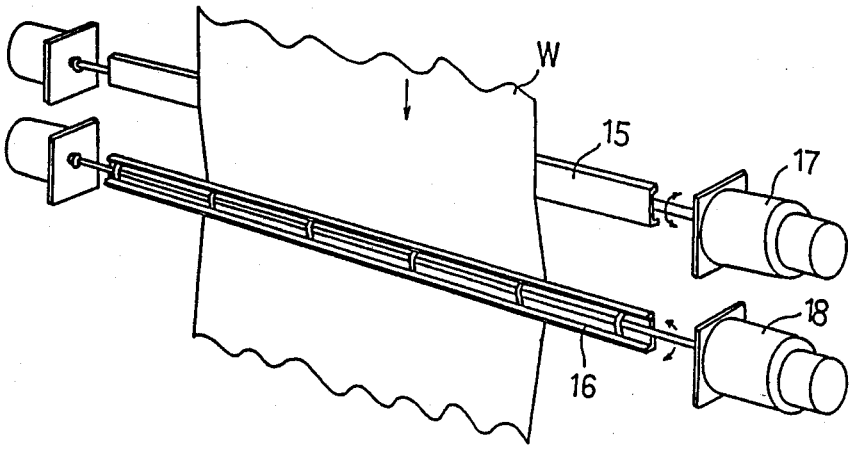

FIG. 2 shows the perspective view of vibrating mechanism including ultra-sonic vibration generators 13 and 14. Each of them contacts cloth W linearly in the horizontal direction to transfer micro-vibrating motion. FIG. 3 shows the perspective view of vibrating mechanism of an oscillator in rotary plate type with oscillating rotary plates 15 and 16 which are arranged horizontally being spaced with a certain vertical interval.

Both of the plates turn at about 30° angle with rotational drives 17 and 18. Accordingly, the plates function to fold and bend cloth as shown in FIG. 3 to keep a direct and forced contact with cloth so that their micro-vibrating motion can be transferred directly to cloth.

As the vibrating motion is transferred directly to cloth W in stretching form, cloth W is vibrated without fail. In addition, water tanks 3, 4, and 5 are so smaller than those known in the prior art that the more frequent replacement of water can be performed.

According to the washing machine of the above construction, cloth W guided by the guide roller L1 upward is loaded with heavy water, more or less almost three times as heavy as cloth itself in consequence of being first supplied into the first water tank 3. However, the vibrating motion given by the unit B1 removes such water effectively down to half of the cloth weight. Cloth W is, thus processed through the first half portion of steaming chamber 1. During so processed, the temperature of cloth W rises nearly to 100° C. to make the construction and fiber of cloth, dirts and impurities contained therein swell. Swelling effect helps dirt and impurities remain deeply in the construction of cloth to come up to the surface to make them ready to run off.

Also, 100° C. steam in which cloth W is processed up and down heats up even the stained fat and oily impurities hotter than their melting points to be soluble in water and removable easily, The dirt and impurities are thus quickly washed out from cloth, when soaked into water in the second water tank 4. Temperature of water in the second water tank 4 also rises so much to improve washing effect in consequence of being contacted both with steam and heated cloth W.

Cloth W coming out from the second water tank 4 is further given vibrating motion by the unit of vibrating mechanism B2 so that dirts and impurities still remained after processed at the first half section are now washed off. In the third water tank 5, dirts and impurities being more swelled and soluble sufficiently are finally washed off. Namely, fresh water from the shower 9 brings out dirts and impurities from cloth completely. The squeezing roller 8 squeezes water out of cloth considerably.

Foregoing are the futures of the cloth washing machine being provided according to the present invention, but the scope of the invention is not limited to the above description and drawings.

That is, cloth, when conveyed, snakingly moves up and down in the vertical direction in the foregoing embodiment, it can also move snakingly in horizontal direction too, being guided by a group of the guide rollers arranged perpendicularly in rows from a lower part to upper. Three torque motors are arranged to keep cloth stretched in the foregoing embodiment, but one, or more or less than three motors can work, as far as the motor or motors can keep cloth stretched sufficiently. Further, method to keep cloth stretched is not limited to the torque motors. Any other methods can function. Likewise, the number of corresponding unit of vibrating mechanism is not to be limited to two, and the vibrating mechanism itself is not to be limited to those illustrated in FIGS. 2 and 3, but there is another mechanism; a slender bar to which high frequency vibration is given by a vibrator can vibrate cloth directly. Moreover, the number of water tank is neither limited to three, nor always necessary to be smaller in capacity, although the less volume of water for water tank is to improve the washing effect keeping cloth in consecutive contact with fresh water. All of the above modifications or versions are to be included in the scope of the present invention.

The cloth washing machine of the invention is to be so constructed as mentioned above in detail, and the experiment using the machine shows that the cloth washing effect was considerably improved. That is, in a cloth sinking test finding how many seconds or minutes it takes for a piece of cotton cloth cut in 2 ;1 cm by 2 cm to sink, when put afloat on the surface of water, it was found: a test piece processed by the machine built according to the invention took 2.5 seconds, while another sample piece not so washed continued to float over 30 minutes. It has also been found that a test piece washed by a usual soaping machine takes 9.9 seconds to sink. The test piece processed by the machine according to the invention sinks 3–4 times faster than it.

These tests show that cloth processed by the machine was improved in the osmotic performance. Such improvement was resulted mainly from two factors of having given to cloth the vibrating motion directly and kept it stretched, and subsequently from another factor of having made the direct vibrating motion work well to squeeze cloth effectively.

What is claimed is:

1. A cloth washing machine comprising:

a steaming chamber;

a water tank within said steaming chamber; and cloth transporting means for transporting said cloth along a path into and through said steaming chamber and said water tank, said cloth transporting means including a plurality of guide rollers for conveying said cloth along said path, stretching means for stretching said cloth between at least two of said guide rollers along said path, and vibrating means for vibrating said cloth, said vibrating means located within said steaming chamber and outside said water tank at a location where said cloth is stretched between said at least two guide rollers, whereby said vibrating further removes water from said cloth.

2. A cloth washing machine as set forth in claim 1 wherein said vibrating means is located on either side of said path of said cloth through said steaming chamber.

3. A cloth washing washing as set forth in claim 1, said vibrating means comprising a vibrating mechanism within said steaming chamber and outside said water tank, said cloth passing through and vibrated by said vibrating mechanism.

4. A cloth washing machine as set forth in claim 3, wherein said vibrating means further comprises an ultra-sonic micro-vibration generator for driving said vibrating mechanism.

5. A cloth washing machine as set forth in claim 3, wherein said vibrating means further comprises an oscillator for driving said vibrating mechanism and said vibrating mechanism comprises a vibratory plate.

6. A method for removing water from a cloth using a cloth washing machine, said cloth washing machine comprising a steaming chamber, a water tank located within said steaming chamber, and cloth transporting means for transporting said cloth through said steaming chamber and said water tank, said method comprising the steps of:

transporting said cloth along a path through said steaming chamber and said water tank;

stretching said cloth along a portion of said path; and vibrating said cloth along said portion of said path which is located outside said water tank to cause water to be removed from said cloth.

* * * * *